US008272754B2

(12) United States Patent
Siu

(10) Patent No.: US 8,272,754 B2
(45) Date of Patent: Sep. 25, 2012

(54) OUTDOOR CHRISTMAS TREE ASSEMBLY

(75) Inventor: Siu Hung Felix Guinness Siu, Hong Kong (HK)

(73) Assignee: Bell Festive International Decor Limited, Shatin (HK)

( * ) Notice: Subject to any disclaimer, the term of this patent is extended or adjusted under 35 U.S.C. 154(b) by 164 days.

(21) Appl. No.: 12/686,877

(22) Filed: Jan. 13, 2010

(65) Prior Publication Data

US 2010/0284189 A1 Nov. 11, 2010

(30) Foreign Application Priority Data

May 8, 2009 (HK) ..... 09104269.7

(51) Int. Cl.
*F21S 6/00* (2006.01)

(52) U.S. Cl. ..... 362/123; 211/196; 362/249.02; 362/249.19

(58) Field of Classification Search ..... 362/122, 362/123, 249.02, 249.06, 249.19, 806; D11/118, D11/121, 130; 211/181.1, 195, 196, 205; 428/8, 20, 27
See application file for complete search history.

(56) References Cited

U.S. PATENT DOCUMENTS

| | | | | |
|---|---|---|---|---|
| 1,654,427 | A * | 12/1927 | Modlarz | 211/196 |
| 2,806,938 | A | 9/1957 | Henry | |
| 3,647,605 | A * | 3/1972 | Spiegel | 428/27 |
| 3,692,617 | A | 9/1972 | Marks et al. | |
| 4,596,096 | A * | 6/1986 | Heath | 52/6 |
| 4,895,261 | A * | 1/1990 | Yacobian | 211/196 |
| 5,488,549 | A | 1/1996 | Miller et al. | |
| 6,070,848 | A * | 6/2000 | Ogren | 248/523 |
| 6,652,927 | B1 * | 11/2003 | Chen | 428/7 |
| 6,745,991 | B1 * | 6/2004 | Rush | 248/523 |
| 2007/0087142 | A1 | 4/2007 | Irvine | |

FOREIGN PATENT DOCUMENTS

| | | |
|---|---|---|
| CN | 2391522 | 8/2000 |
| CN | 2405515 | 11/2000 |
| CN | 2471256 | 1/2001 |
| CN | 2448227 | 9/2001 |
| CN | 2592076 | 12/2003 |
| CN | 2604941 | 3/2004 |

* cited by examiner

*Primary Examiner* — Hargobind S Sawhney
(74) *Attorney, Agent, or Firm* — Muncy, Geissler, Olds & Lowe, PLLC

(57) ABSTRACT

An outdoor Christmas tree assembly includes a cone-shaped frame (10) formed of frustum-shaped frame segments (12, 14, 16, 18, 20, 22, 24) detachably stacked one on top of the other. Each frame segment includes annular frames (30) and slanted lateral frames (40). One or more frame segments are formed of end-to-end detachably connected arc-shaped frame sections. Tree branches (50) are detachably mounted on the annular frames. Each tree branch may include at least one set of lights, an electric socket, and an electric plug. A harness cord system (78) runs from top to bottom along a lateral side of the frame, and has socket outlets for electrically coupling to the electric plugs of the tree branches. Harness cords are secured to the frame by clamps (71). The frame may be supported on a base structure (200) having therein a working platform (250). The outdoor Christmas tree assembly is also applicable for indoor use.

9 Claims, 9 Drawing Sheets

OUTDOOR CHRISTMAS TREE ASSEMBLY

FIELD OF THE INVENTION

The present invention relates to an outdoor Christmas tree assembly.

BACKGROUND OF THE INVENTION

A Christmas tree assembly is well known for indoor decoration. Outdoor Christmas tree assemblies are not uncommon. These outdoor Christmas tree assemblies are usually much taller than indoor ones and are subject to outdoor weather conditions such as strong wind. One major requirement of these outdoor Christmas trees is that the construction of the tree must be strong to meet safety requirements. However, most of the conventional outdoor Christmas tree assemblies are not covered with proper structural measures. While some existing outdoor Christmas tree assemblies may be safe, they require too many electrical wirings, electrical connections and excessive materials, which make assembling of the tree difficult, time consuming and expensive. There is a need to produce an improved outdoor or indoor Christmas tree assembly wherein the above-mentioned disadvantages can be alleviated.

SUMMARY OF THE INVENTION

According to one aspect, there is provided an outdoor Christmas tree assembly including a generally cone-shaped frame formed of a plurality of generally frustum-shaped frame segments detachably stacked one on top of the other. Each frame segment has a plurality of generally annular frames spaced vertically apart from each other, and a plurality of circumferentially spaced apart slanted lateral frames connecting the annular frames. One or more frame segments are formed of a plurality of end-to-end detachably connected generally arc-shaped frame sections. A plurality of tree branches is detachably connected to the annular frames. The outdoor Christmas tree assembly is also applicable for indoor use.

In one embodiment, each tree branch includes at least one set of lights, an electric socket, and an electric plug that are electrically connected together. A harness cord system runs substantially from top to bottom along a lateral side of the cone-shaped frame. The harness cord system has a plurality of harness cords each having a plurality of socket outlets for electrically coupling to the electric plugs of the tree branches.

In one embodiment, a plurality of sets of lights, electric sockets, and electric plugs are electrically connected together, and are in turn electrically connected to each socket outlet of the harness cords.

In one embodiment, the annular frames and the lateral frames are made of metal tubes. The metal tubes are fastened together by U-clamps and nuts screwed into threaded portions of the U-clamp.

In one embodiment, the annular frames are provided with metal sleeves for receiving therein ends of the tree branches. Anti-UV cable ties or stainless steel cable ties are employed to fasten the tree branches to the metal sleeves.

In one embodiment, a plurality of triangular reinforcing members is used to secure the tree on the ground. One side of each triangular reinforcing member is detachably fastened to one lateral frame of a ground-engaging frame segment of the tree, and another side is detachably fastened to the ground.

In one embodiment, a bracing device in the form of an inner frame formed of a plurality of metal tubes into a polygonal shape is adapted to be fastened within one or more of the annular frames.

In one embodiment, a working platform is built within a generally frustum-shaped base structure on which the cone-shaped frame is mounted. The frustum-shaped base structure and the cone-shaped frame have continuing lateral sides.

In one embodiment, the plurality of harness cords is secured to the cone-shaped frame by metal clamps. Each metal clamp includes a pair of legs resting on top of an annular frame at two opposite sides of a lateral frame respectively, a plate abutting against an inner surface of the lateral frame, and a pair of fastening belts coupling to the pair of legs respectively so that the harness cords can be held in position by the fastening belts of the metal clamp.

According to another aspect, there is provided a kit for building a Christmas tree comprising a plurality of frame sections and a plurality of tree branches.

According to a further aspect, there is provided a kit for building a Christmas tree comprising a plurality of harness cords with socket outlets, as well as a plurality of tree branches each having at least one set of lights, an electric socket, and an electric plug that are electrically connected together.

Although the invention is shown and described with respect to certain embodiments, it is obvious that equivalents and modifications will occur to others skilled in the art upon the reading and understanding of the specification. The invention in the present application includes all such equivalents and modifications, and is limited only by the scope of the claims.

BRIEF DESCRIPTION OF THE DRAWINGS

Specific embodiments of the invention will now be described by way of example with reference to the accompanying drawings wherein.

DETAILED DESCRIPTION OF THE INVENTION

Reference will now be made in detail to a preferred embodiment of the invention, examples of which are also provided in the following description. Exemplary embodiments of the invention are described in detail, although it will be apparent to those skilled in the relevant art that some features that are not particularly important to an understanding of the invention may not be shown for the sake of clarity.

Figure 1:
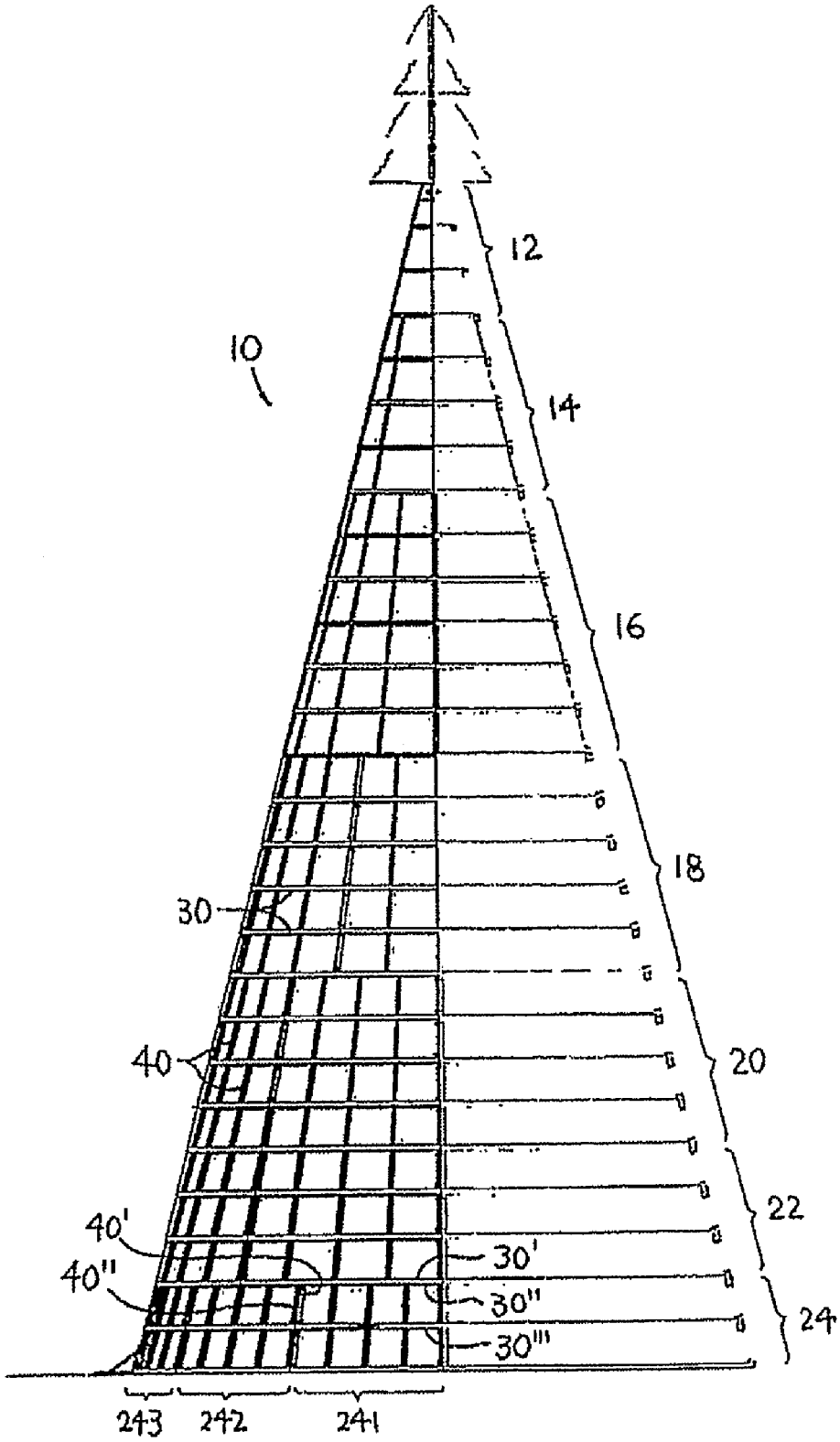
FIG. 1 is an illustrative side view of the outdoor Christmas tree frame according to an embodiment of the present invention.

FIG. 1 is an illustrative side view of an outdoor Christmas tree assembly according to an embodiment of the present invention. The tree assembly includes a generally cone-shaped frame generally designated by reference numeral 10. The cone-shaped frame 10 may be formed of a plurality of generally frustum-shaped frame segments 12, 14, 16, 18, 20, 22, 24 detachably stacked one on top of the other. According to the exemplary embodiment, there are seven frame segments 12, 14, 16, 18, 20, 22, 24. The lowermost frame segment 24 is the largest frame segment, and the uppermost frame segment 12 is the smallest frame segment of the tree.

Each frustum-shaped frame segment 12, 14, 16, 18, 20, 22, 24 has a plurality of generally annular frames 30 spaced vertically apart from each other, and a plurality of circumferentially spaced apart slanted lateral frames 40 connecting the annular frames 30. At least some of the frame segments 12, 14, 16, 18, 20, 22, 24 at the lower portion of the cone-shaped frame 10 can be formed of a plurality of end-to-end detachably connected generally arc-shaped frame sections. For example, the lowermost frame segment 24 of the cone-shaped frame 10 may be formed of 8 or 10 end-to-end detachably connected arc-shaped frame sections 241, 242, 243 and so on. Upper and smaller frame segments may have 2, 4 or 6 frame sections. The annular frames 30 and the lateral frames 40 may be in the form of hollow metal tubes, such as steel tubes. The hollow metal tubes may be circular or square in cross section.

Figure 4:
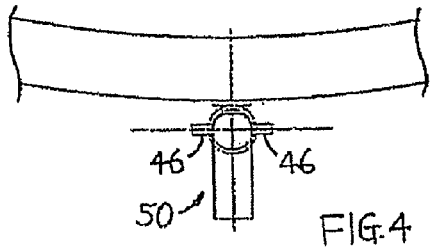
FIG. 4 is a top view of the tree branch being inserted into the sleeve of the tree frame as illustrated in FIG. 3.
Figure 2:
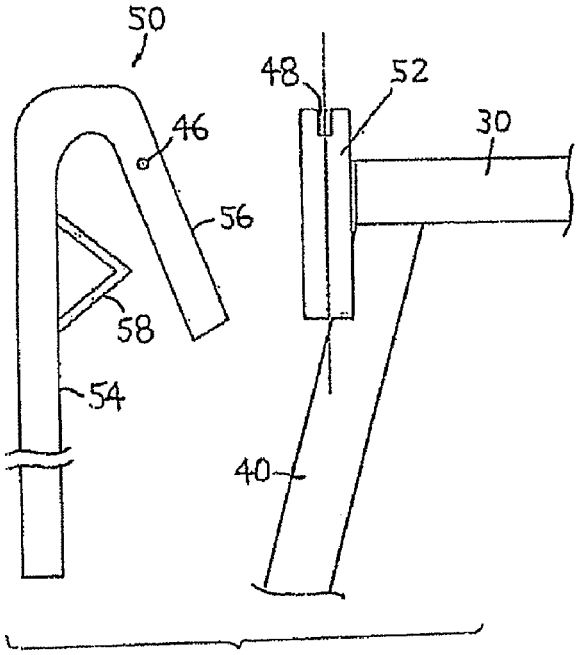
FIG. 2 shows a tree branch before insertion into a sleeve of a tree frame.
Figure 3:
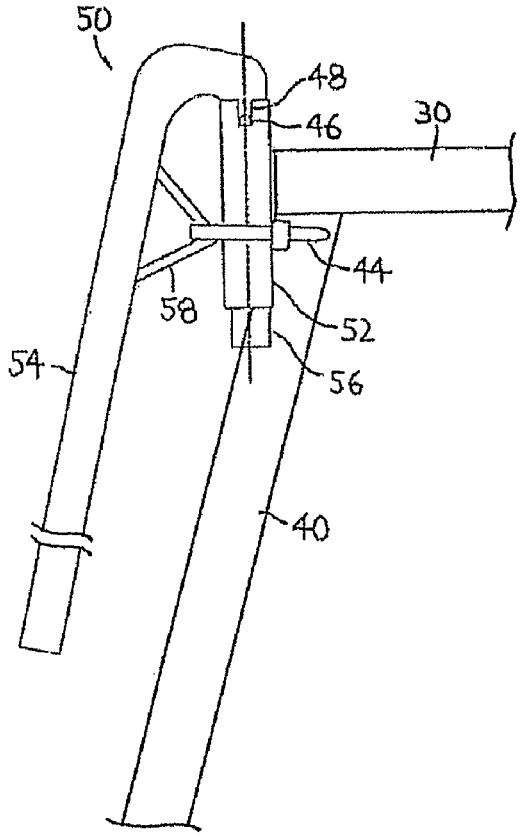
FIG. 3 shows a tree branch after insertion into the sleeve of the tree frame.

The outdoor Christmas tree assembly also includes a plurality of tree branches 50. FIGS. 2-4 show the tree branch 50 and the insertion of the tree branch 50 into a metal sleeve 52 provided on the annular frame 30 of the tree. A plurality of the metal sleeves 52 may be welded onto each metal annular frame 30. The tree branch 50 may be in the form of a metal rod bent into the shape of a hook having a long arm 54, curved portion, and a short arm 56. The short arm 56 has two pins 46 that can fit into two corresponding slots 48 formed on an upper edge of the metal sleeve 52. When the tree branch 50 is inserted into the metal sleeve 52, the two pins 46 engage with the two slots 48 thereby limiting rotational movement of the tree branch 50 relative to the cone-shaped frame 10 of the tree. Two metal rods can be twisted around each other to form a stronger tree branch if necessary.

A cable tie 44 may be employed to fasten each tree branch 50 to each metal sleeve 52. The cable tie 44 may be made of anti-UV, or stainless steel, or any other suitable material. To fasten, the cable tie 44 is tied around the metal sleeve 52 and an ear 58 formed on the long arm 54. The cable tie 44 securely holds the tree branch 50 in the metal sleeve 52 and prevents the short arm 56 from sliding out from the metal sleeve 52.

Figure 5:
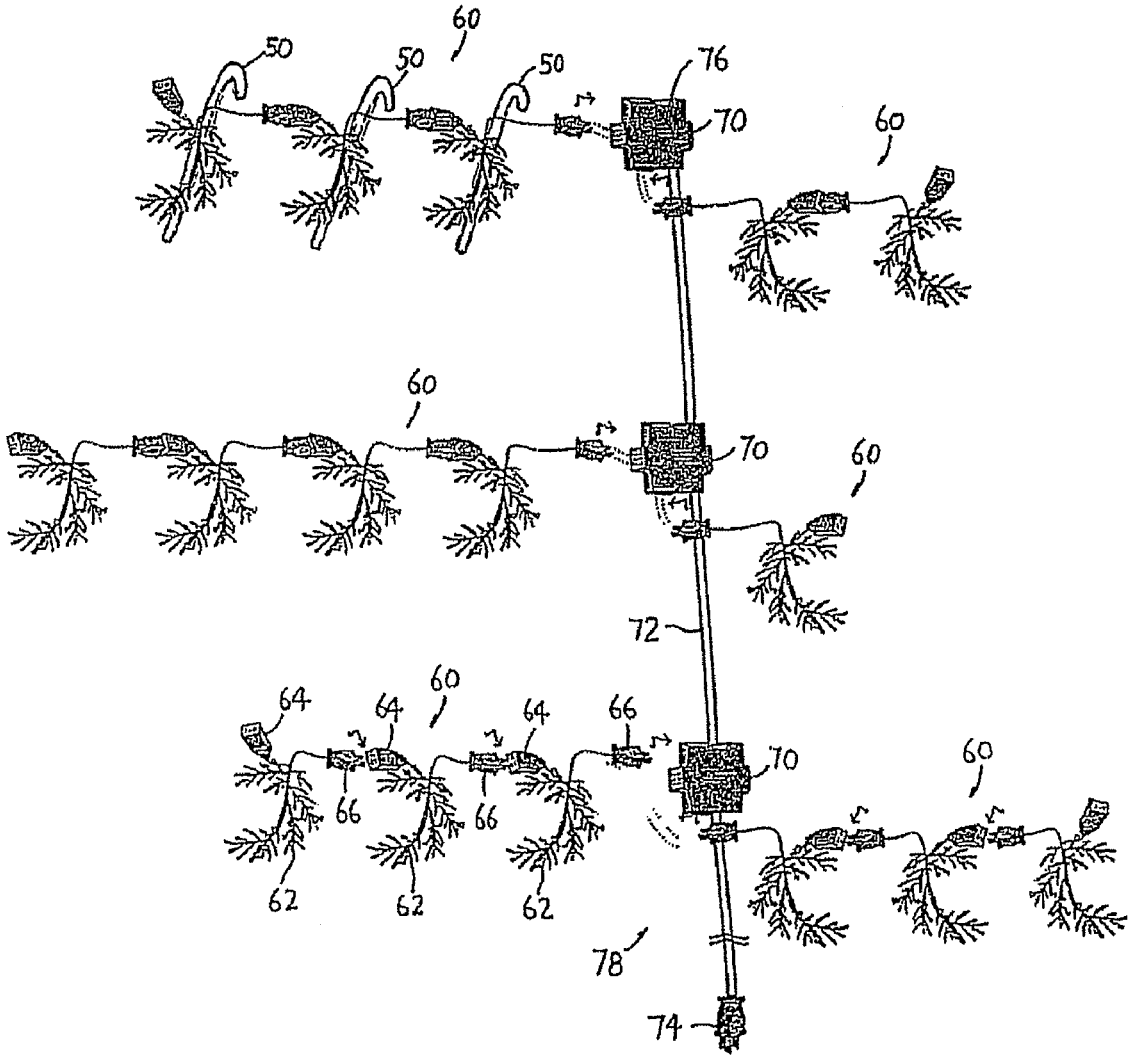
FIG. 5 is a diagrammatical view of groups of Christmas lights and leaves.

FIG. 5 is a diagrammatical view of groups of Christmas lights (and leaves) generally designated by reference numeral 60. According to the exemplary embodiment, each group of Christmas lights 60 contains one or more sets of lights 62, electric sockets 64 and electric plugs 66. Each tree branch 50 is adapted to carry one set of lights 62, one electric socket 64 and one electric plug 66 that are electrically connected together for electrical connection with adjacent tree branches 50 carrying further sets of lights 62, electric sockets 64 and electric plugs 66. This can minimize the use of excessive connection points and hence the use of excessive materials for building the tree. Although it has been shown and described that each tree branch 50 carries a set of lights, it is contemplated that the tree branches may not necessary carry any lights, or each tree branch may carry more than one set of lights.

Figure 5A:
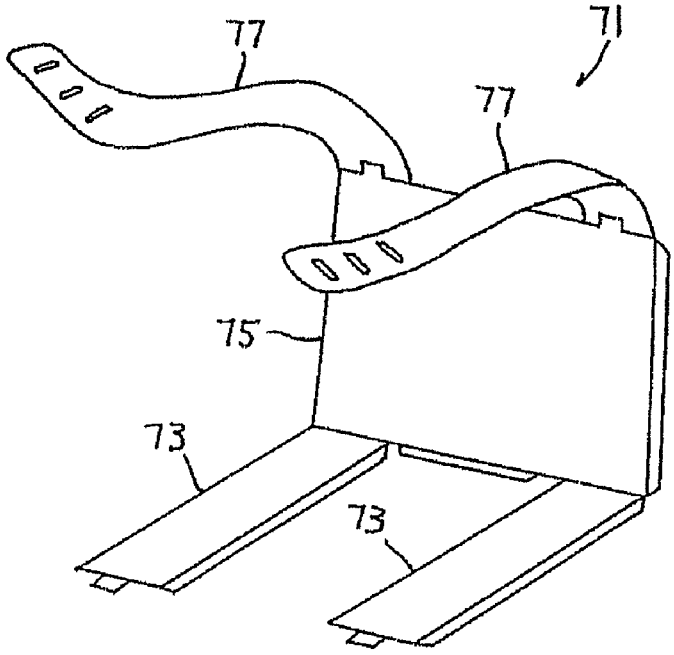
FIGS. 5*a* and 5*b* show the fastening of the harness cords to the frame by metal clamps.
Figure 5B:
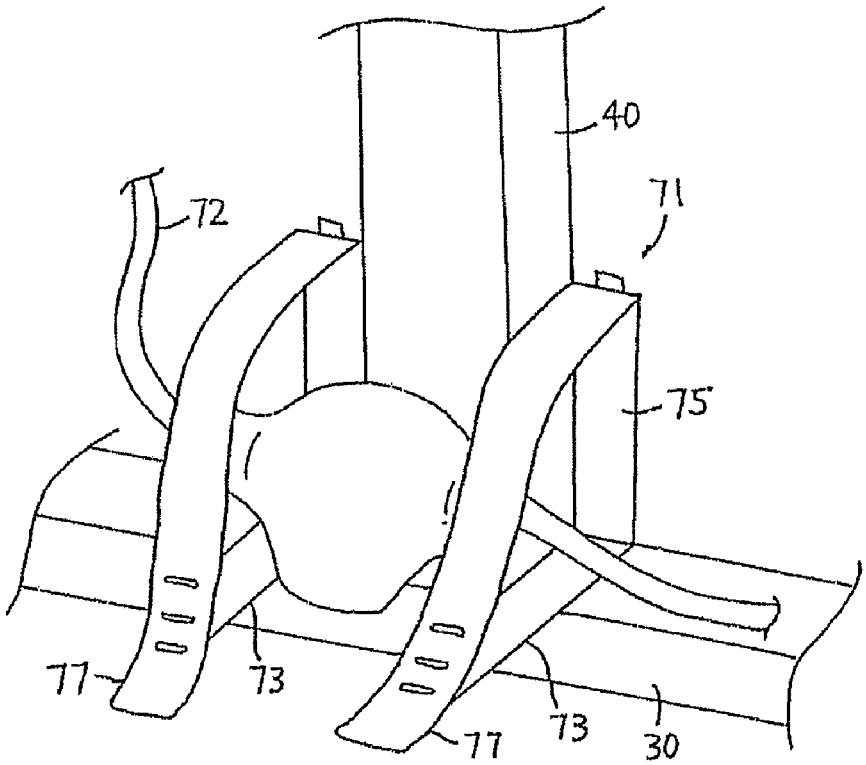

One of the electric plugs 66 of a group 60 of the connected lights 62 and electric socket and plugs 64, 66 is adapted to be plugged into a socket outlet 70 provided on a harness cord 72. A plurality of harness cords 72 is connected together end-to-end by electric plugs 74 and sockets 76 to form a harness cord system 78 extending substantially vertically from top to bottom along the lateral side of the cone-shaped frame 10 of the tree. The outlets of the harness cords 72 can be held in position by metal clamps 71 attached to the frame segments, as shown in FIGS. 5*a* and 5*b*, so that the whole harness cord system 78 can be mounted on the frame 10. The metal clamp 71 may include a pair of legs 73 resting on top of an annular frame 30 at two opposite sides of a lateral frame 40 respectively, a plate 75 abutting against an inner surface of the lateral frame 40, and a pair of fastening belts 77 coupling to the pair of legs 73 respectively so that the harness cord 72 can be held in position by the fastening belts 77 of the metal clamp 71.

The vertical harness cord system of the present application can reduce the total length of the harness cords, and avoid the need for a socket outlet at every tree branch location of the entire tree. This can reduce the electrical wiring material needed to light up the tree, and makes wiring quick and less complicated. This can minimize excessive use of materials needed to assemble the tree. Furthermore, this can increase the efficiency of assembling the tree. The Christmas tree assembly is applicable for both outdoor and indoor use.

Figure 6:
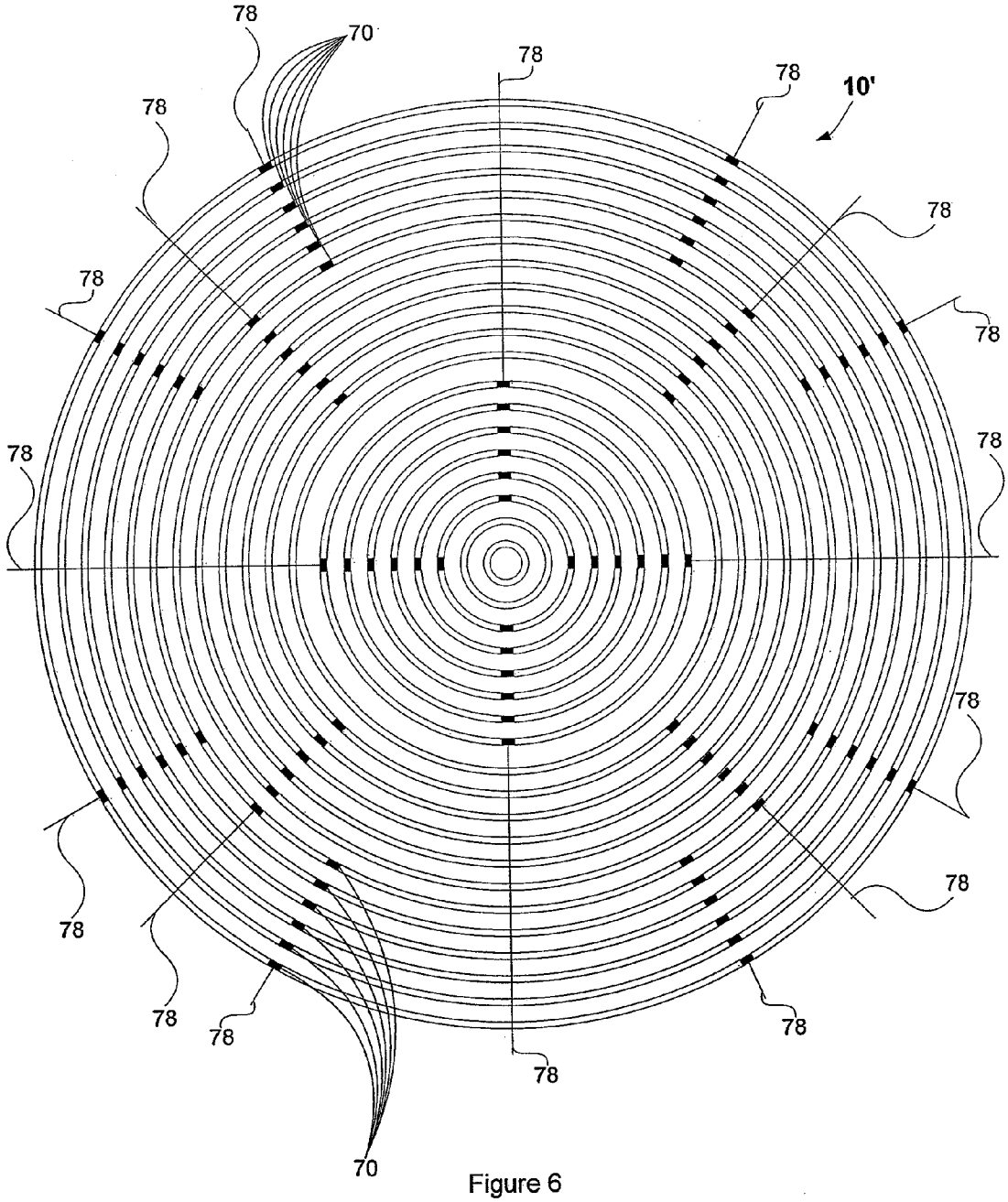
FIG. 6 is a top view of the outdoor Christmas tree frame showing the location of the harness cords and the distribution of the electric sockets.

FIG. 6 is a top view of an outdoor Christmas tree frame 10' showing an example the location of the harness cords 78 and the distribution of socket outlets 70 on the harness cords 78. Distribution of socket outlets 70 may vary with power consumption requirement as required by the nature of light fitting (e.g. more sockets for pin lights, changing color or multi-harness, and fewer sockets for LED lights).

Figure 7:
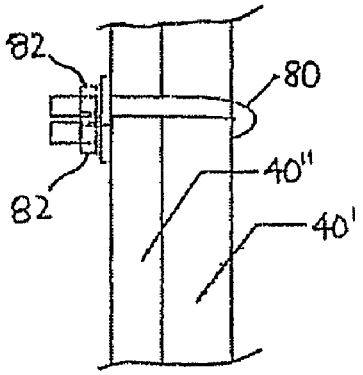
FIG. 7 is a side perspective view of a round lateral frame and a square lateral frame being fastened together by a U-clamp and nuts.

FIG. 7 is a side perspective view of a round lateral frame 40' and a square lateral frame 40" being fastened together by a U-clamp 80 and nuts 82. As mentioned hereinbefore, at least some of the frame segments 12, 14, 16, 18, 20, 22, 24 at the lower portion of the cone-shaped frame 10 can be formed of a plurality of end-to-end detachably connected arc-shaped frame sections. As illustrated in FIG. 1, the round lateral frame 40' of the frame section 241 is adapted to be connected to the square lateral frame 40" of the adjacent frame section 242 by a plurality of U-clamps 80 and nuts 82.

Figure 8:
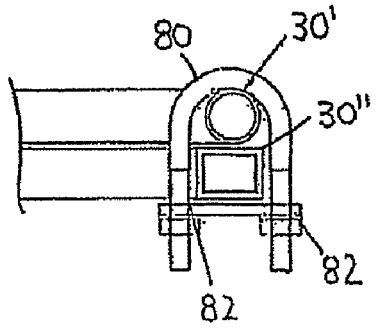
FIG. 8 is a cross sectional view of a round annular frame and a square annular frame being fastened together by a U-clamp and nuts.

FIG. 8 is a cross sectional view of a round annular frame 30 and a square annular frame 30' being fastened together by U-clamp 80 and nuts 82. As described hereinbefore, a plurality of frustum-shaped frame segments 12, 14, 16, 18, 20, 22, 24 is detachably stacked one on top of the other. As illustrated in FIG. 1, the lowermost round annular frame 30' of the upper frame segment 22 can be connected to the uppermost square annular frame 30" of the lower frame segment 24 by a plurality of U-clamps 80 and nuts 82.

As illustrated in FIG. 8, the round metal tube 30' is fitted within the U-shaped portion of the U-clamp 80, and the square metal tube 30" is fitted between the two parallel portions of the U-clamp 80. Two nuts 82 are screwed into the two threaded portions of the U-clamp 80 respectively. This can make assembly of the tree quick and easy as compared to the existing method that uses metal plates, bolts and nuts needed to fasten two square metal tubes together. The fastening system can reduce the number of fastening components necessary to assemble the tree so that a person assembling the tree is not require to carry too many heavy fastening components with him up the tree during assembling. Furthermore, the fastening system can reduce the time required to assemble the tree.

Figure 10:
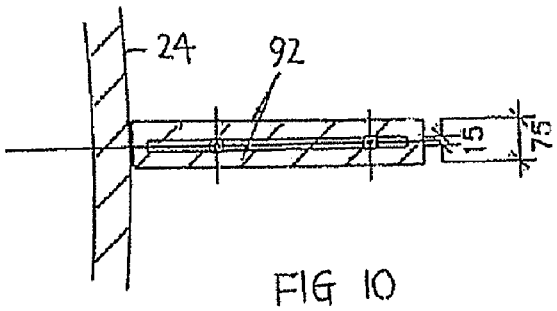
FIG. 10 is a top view of the metal tubes of the triangular reinforcing frame in FIG. 9.
Figure 9:
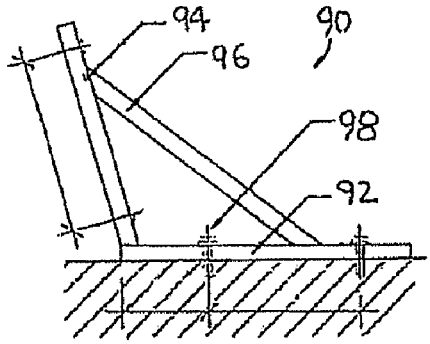
FIG. 9 is a side view of a triangular reinforcing frame.

FIG. 9 is a side view of a triangular reinforcing member generally represented by reference numeral 90. The triangular reinforcing member 90 includes metal tubes 92, 94, 96. Metal tubes 92 are fastened to the ground by bolts 98. Metal tubes 94 are fastened to lateral frames 40', 40" of the lowermost frame segments 24 by through-bolts or any other appropriate fastening means. The metal tubes 92, 94, 96 can be in the form of square metal tubes, or solid metal structures. FIG. 10 is a top view of the metal tubes 92 of the triangular reinforcing member 90. These triangular reinforcing member 90 serves as supporting feet for load transfer and stability.

Figure 11:
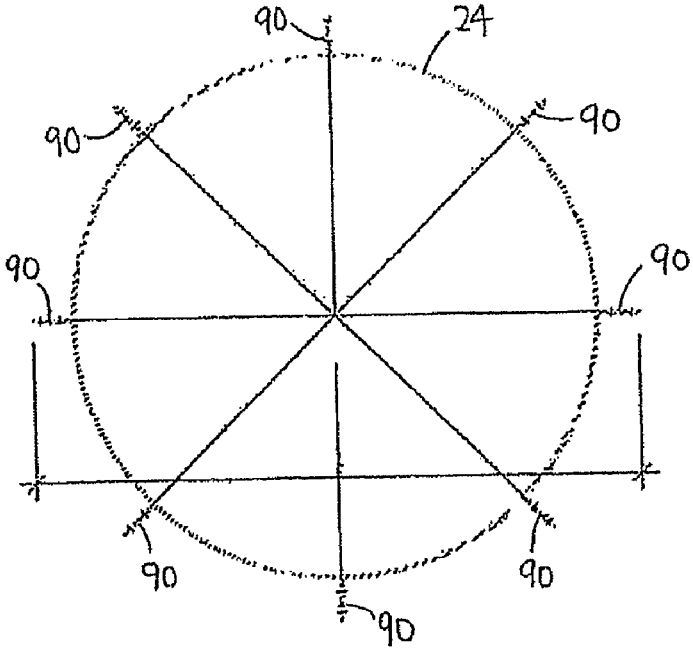
FIG. 11 is an illustrative diagram showing the base of the tree reinforced by eight triangular reinforcing members shown in FIG. 9.

FIG. 11 is an illustrative diagram showing the use of eight triangular reinforcing members 90 to firmly hold the cone-shaped frame 10 on the ground. According to the illustrated embodiment, the eight triangular reinforcing members 90 are spaced equidistantly and circumferentially about the perimeter of the lowermost frame segment 24 of the cone-shaped frame 10. It is understood that the number of reinforcing members 90 may vary depending on the height of the tree.

Figure 13:
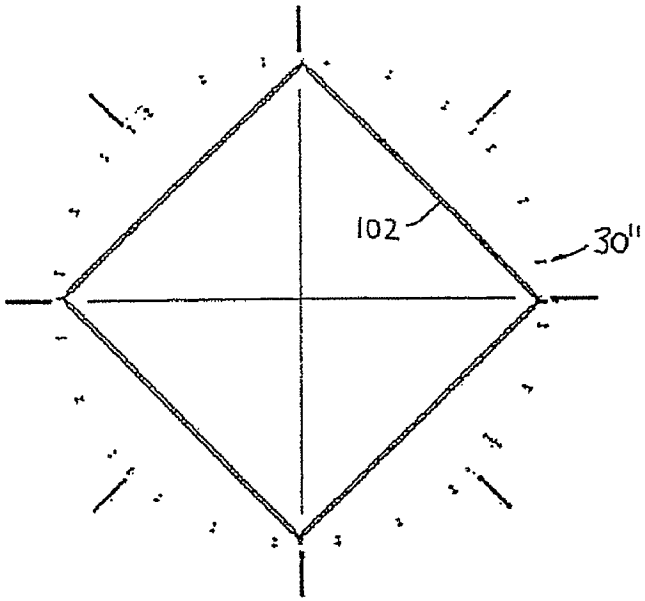
FIGS. 12 and 13 show the use of square inner frames within frame segments of the tree.
Figure 12:
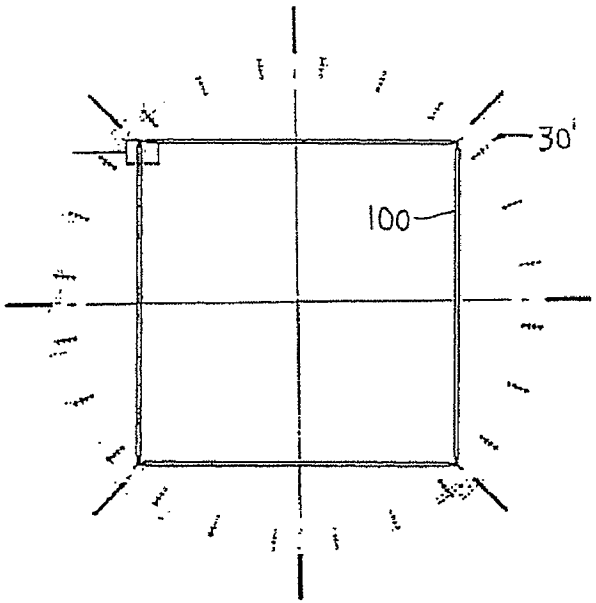
Figure 14:
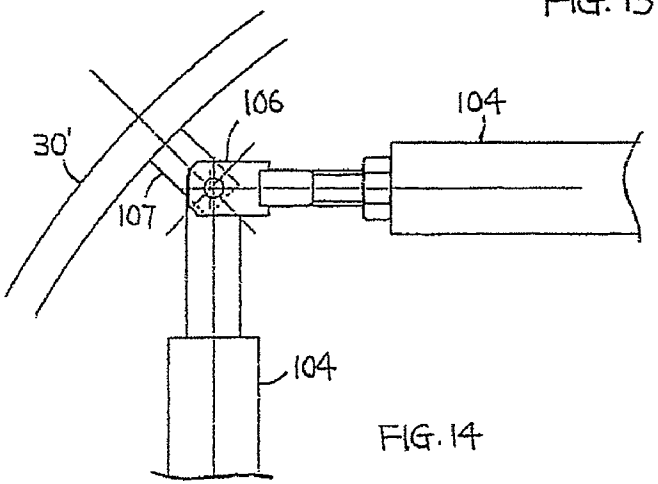
FIG. 14 is an enlarged fragmentary view at the joint of the square inner frames of FIGS. 12 and 13.

FIGS. 12 and 13 show the use of bracing devices in the form of square inner frames 100, 102 to strengthen the structure of one or more of the frame segments 12, 14, 16, 18, 20, 22, 24 of the tree. As an example, the first square inner frame 100 can be fastened within an upper annular frame 30" of the frame segment 24, and the second square inner frame 102 can be fastened within a lower annular frame 30'" of the frame segment 24. Each of the square inner frames 100, 102 is made of four metal tubes 104 connected together at four joints 106, as depicted in the enlarged fragmentary view in FIG. 14. Each joint 106 may be connected to a metal plate 107 welded to the annular frame 30'. The square inner frame 100, 102 is substantially disposed on the same plane of the annular frame within which it is connected. The four metal tubes 104 may be in the form of round or square metal tubes. Although it has been shown and described that the inner frames 100, 102 are square in shape, it is understood by one skilled in the art that the inner frames can be of any polygonal shape such as triangle, hexagon, etc.

Using the system described hereinbefore, a 50 ft tall outdoor Christmas tree can be easily and quickly assembled. The outdoor Christmas tree can meet the outdoor requirements and is approved by Registered Structural Engineer.

Figure 15:
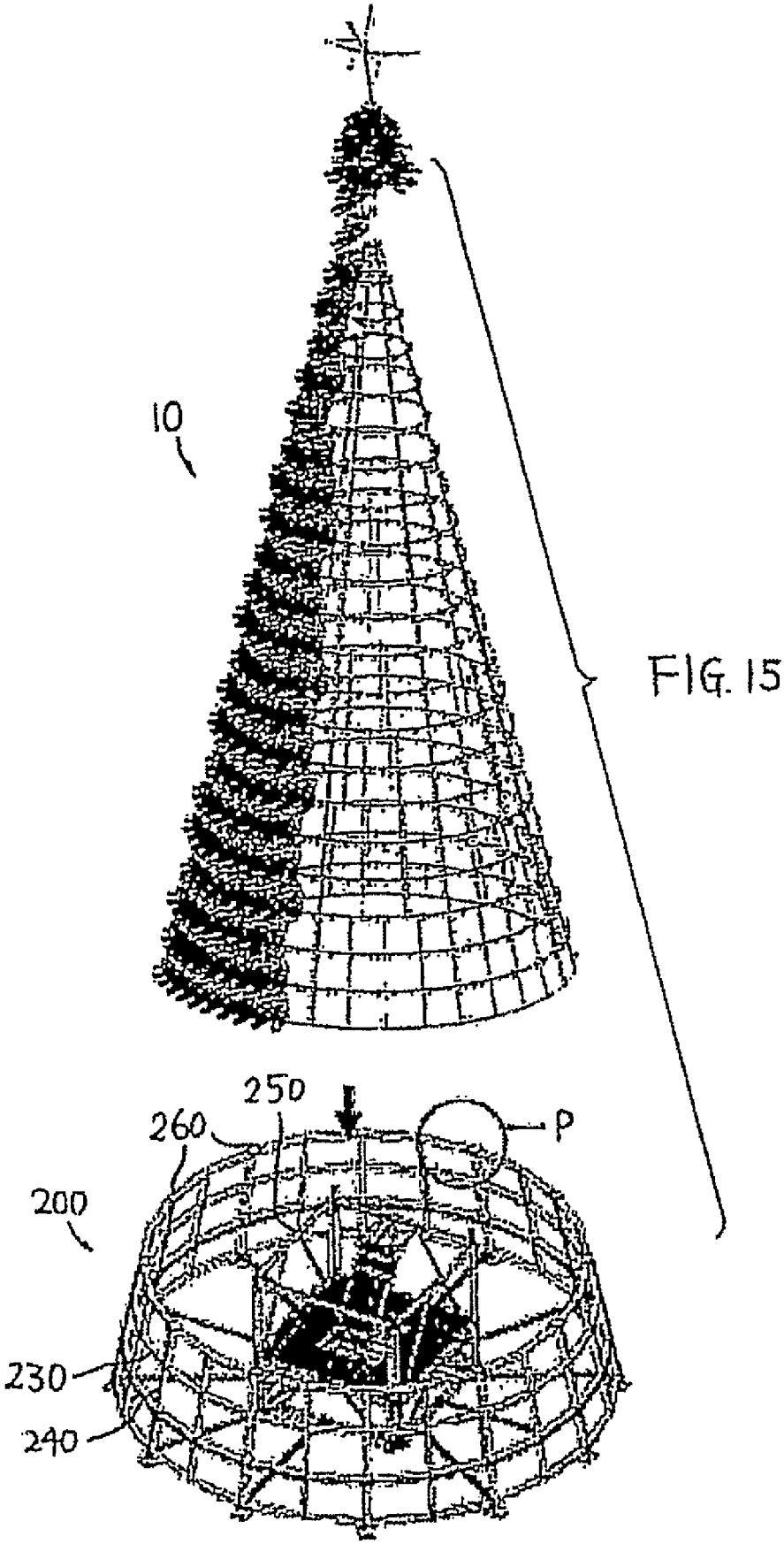
FIG. 15 is a perspective view of a supporting base structure of the outdoor Christmas tree frame.

FIG. 15 is a perspective view of an additional base structure 200 of the outdoor Christmas tree frame of the present application. The base structure 200 may be frustum-shaped and may include a plurality of vertically spaced apart annular frames 230, and a plurality of circumferentially spaced apart slanted lateral frames 240 connecting the annular frames 230. A working platform 250 can be built and fastened within the base structure 200. The working platform 250 may have different levels and a ladder running from one level to another level.

To assemble a relatively shorter outdoor Christmas tree, the simple construction of the frame 10 shown in FIG. 1 can be adopted. If a much taller outdoor Christmas tree is to be assembled, the base structure 200 and the working platform 250 can be built first so as to form a strong and stable foundation on which the frame 10 can be built and supported.

Figure 17:
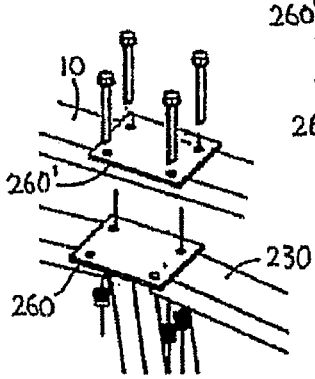
FIGS. 16 and 17 are enlarged fragmentary views of a fastening metal plate at P provided on the supporting base structure in FIG. 15.
Figure 16:
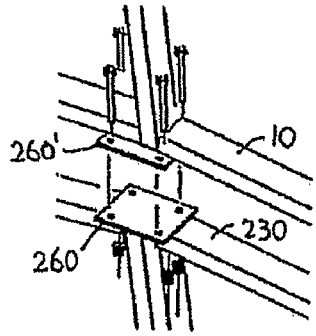

FIGS. 16 and 17 are enlarged fragmentary views of a metal plate 260 at P provided on the supporting base structure in FIG. 15. It can be seen that a plurality of metal plates 260 can be provided on the uppermost annular frame 230 of the base structure 200. Similar metal plates 260' may be provided at matching positions of the lowermost annular frame of the cone-shaped frame 10. Bolts can be inserted through alignment holes in the metal plates 260, 260', and nuts are used to tightly fasten the lowermost frame segment of the frame 10 to the base structure 200.

Figure 18:
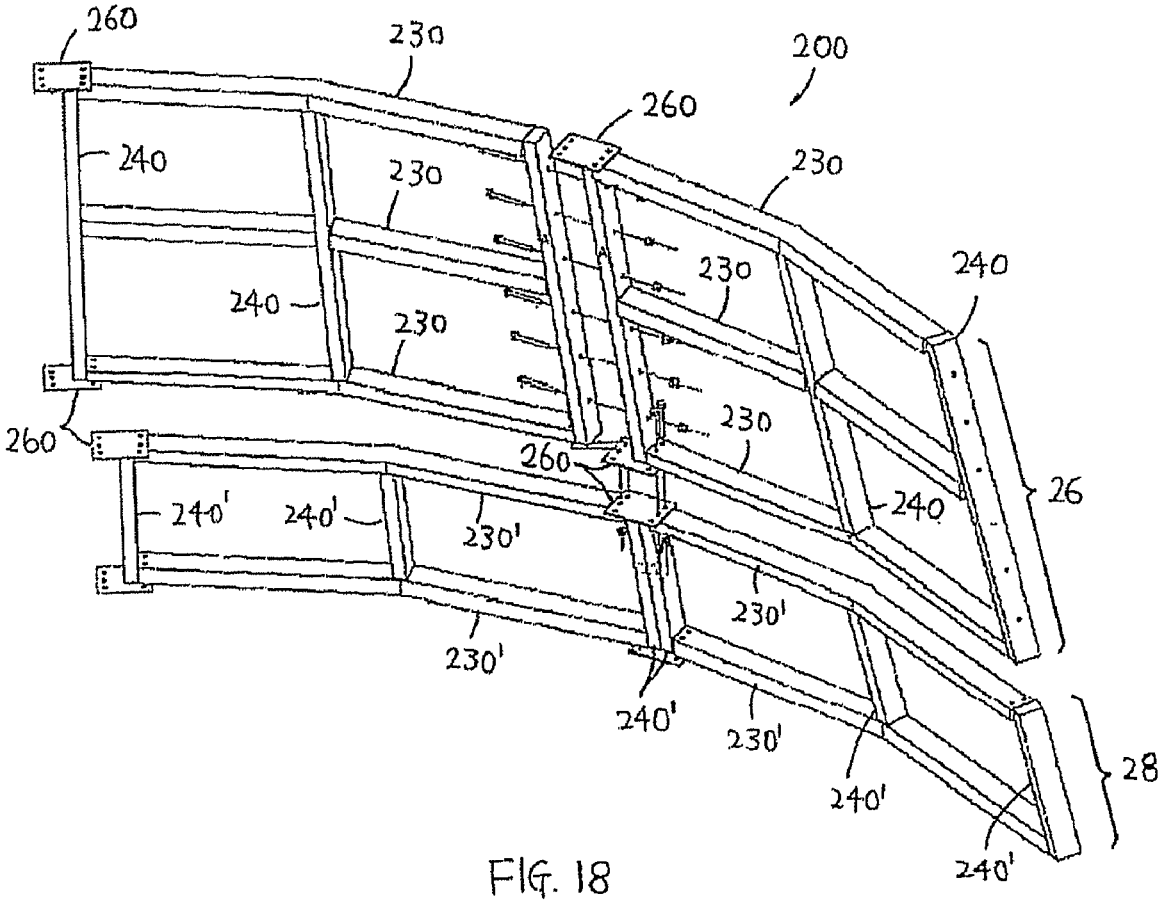
FIG. 18 shows the detailed construction of the supporting base structure.

FIG. 18 shows the detailed construction of the supporting base structure 200. The base structure 200 may include a generally frustum-shaped upper frame segment 26 and a generally frustum-shaped lower frame segment 28. The upper frame segment 26 may have a structure similar to that of the frame segment 24 of the frame 10. The upper frame segment 26 may be formed of a plurality of end-to-end detachably connected frame sections. Each frame section may be formed of a plurality of horizontal frames 230 and a plurality of slanted lateral frames 240. The frame sections can be fastened to each other by bolts. Similarly, the lower frame segment 28 may also be formed of a plurality of horizontal frames 230' and a plurality of slanted lateral frames 240'. The upper frame segment 26 can be fastened to the lower frame segment 28 by metal plates and bolts in a way similar to the fastening of the base structure 200 to the frame 10 as illustrated in FIG. 16.

The outdoor Christmas tree assembly can be easily assembled and can be detachable and reusable. The assembly contains frame segments and tree branches with standardized parts that are interchangeable. This can reduce the time and effort needed to assemble the tree. The design of the assembly can have environmental impact achievable through the use of standardized parts in order to minimize the use of excessive materials.

The frame sections 241, 242, 243 and so on of the frame segments 12, 14, 16, 18, 20, 22, 24 as well as tree branches 50 can be sold in a kit so that customers can build a Christmas tree according to their needs.

The harness cords 72 with socket outlets 70, as well as tree branches 50 having sets of lights 62, electric socket 64, and electric plugs 66 that are electrically connected together can also be sold in a kit.

While the invention has been shown and described with particular references to a number of preferred embodiments thereof, it should be noted that various other changes or modifications may be made without departing from the scope of the appended claims.

What is claimed is:

1. An outdoor Christmas tree assembly comprising:

(a) a generally cone-shaped frame having a plurality of generally frustum-shaped frame segments detachably stacked one on top of the other;

(b) each frame segment having a plurality of generally annular frames spaced vertically apart from each other, and a plurality of circumferentially spaced apart slanted lateral frames connecting said annular frames, one or more of said frame segments being formed of a plurality of end-to-end detachably connected generally arc-shaped frame sections;

(c) a plurality of tree branches detachably connected to said annular frames, wherein each of said plurality of tree branches includes at least one set of lights, an electric socket, and an electric plug that are electrically connected together; and (d) a harness cord system running substantially from top to bottom along a lateral side of said cone-shaped frame, said harness cord system having a plurality of harness cords each having a plurality of socket outlets for electrically coupling to said electric plugs of said tree branches, wherein said plurality of harness cords is secured to said cone-shaped frame by metal clamps, and wherein each of said metal clamps includes a pair of legs resting on top of said annular frame at two opposite sides of said lateral frame respectively, a plate abutting against an inner surface of said lateral frame, and a pair of fastening belts coupling to said pair of legs respectively.

2. The assembly as claimed in claim 1, wherein a plurality of sets of lights, electric sockets, and electric plugs are electrically connected together, and are in turn electrically connected to each socket outlet of said harness cords.

3. The assembly as claimed in claim 1, wherein the uppermost annular frame of a lower frame segment is detachably fastened to the lowermost annular frame of an adjacent upper frame segment.

4. The assembly as claimed in claim 1, wherein said annular frames and said lateral frames are made of metal tubes.

5. The assembly as claimed in claim 4, wherein the metal tubes are fastened together by U-clamps and nuts screwed into threaded portions of said U-clamp.

6. The assembly as claimed in claim 1, wherein said annular frames are provided with sleeves for receiving therein ends of said tree branches.

7. The assembly as claimed in claim 6, further comprising cable ties for fastening said tree branches to said sleeves, said cable ties being anti-UV cable ties or stainless steel cable ties.

8. An outdoor Christmas tree assembly comprising:

a generally cone-shaped frame having a plurality of generally frustum-shaped frame segments detachably stacked one on top of the other;

each frame segment having a plurality of generally annular frames spaced vertically apart from each other, and a plurality of circumferentially spaced apart slanted lateral frames connecting said annular frames, one or more of said frame segments being formed of a plurality of end-to-end detachably connected generally arc-shaped frame sections;

a plurality of tree branches detachably connected to said annular frames; and a plurality of triangular reinforcing members, one side of each triangular reinforcing member being detachably fastened to one lateral frame of a ground-engaging frame segment and another side being detachably fastened to the ground.

9. An outdoor Christmas tree assembly comprising:

a generally cone-shaped frame having a plurality of generally frustum-shaped frame segments detachably stacked one on top of the other;

each frame segment having a plurality of generally annular frames spaced vertically apart from each other, and a plurality of circumferentially spaced apart slanted lateral frames connecting said annular frames, one or more of said frame segments being formed of a plurality of end-to-end detachably connected generally arc-shaped frame sections;

a plurality of tree branches detachably connected to said annular frames; and a bracing device in the form of an inner frame formed of a plurality of metal tubes into a polygonal shape, and adapted to be fastened within one or more of said annular frames.

* * * * *